US007222405B2

(12) United States Patent
Naito

(10) Patent No.: US 7,222,405 B2
(45) Date of Patent: May 29, 2007

(54) DEVICE FOR DETERMINING AXIAL ALIGNMENT OR MISALIGNMENT OF A PUNCH WITH RESPECT TO A DIE

(75) Inventor: Nobuharu Naito, Toyohashi (JP)

(73) Assignee: Newfrey LLC, Newark, DE (US)

( * ) Notice: Subject to any disclaimer, the term of this patent is extended or adjusted under 35 U.S.C. 154(b) by 351 days.

(21) Appl. No.: 10/844,334

(22) Filed: May 13, 2004

(65) Prior Publication Data

US 2004/0261245 A1 Dec. 30, 2004

(30) Foreign Application Priority Data

May 27, 2003 (JP) ..... 2003-148921

(51) Int. Cl.
*B25B 27/14* (2006.01)
*B23Q 3/00* (2006.01)

(52) U.S. Cl. ..... 29/271; 29/465

(58) Field of Classification Search ..... 29/465, 29/407.09, 432, 464, 466, 257, 263, 271, 29/270; 72/391.4; 33/627
See application file for complete search history.

(56) References Cited

U.S. PATENT DOCUMENTS 2,341,284 A * 2/1944 Payne ..... 33/627
5,277,049 A 1/1994 Endo ..... 72/391.4

* cited by examiner

*Primary Examiner*—John C. Hong
(74) *Attorney, Agent, or Firm*—Miles & Stockbridge P.C.

(57) ABSTRACT

In an apparatus in which workpieces are joined by self-piercing rivets, for example, a jig is used to determine whether axial alignment of a punch and a die is within an acceptable range. The jig substitutes for a die and has a shank and a head, the shank fitting within a die-receiving bore of the apparatus and the head having an axial opening receiving the punch when alignment is within the acceptable range. The head is constructed to permit viewing of the relationship of the punch and the opening.

6 Claims, 5 Drawing Sheets

DEVICE FOR DETERMINING AXIAL ALIGNMENT OR MISALIGNMENT OF A PUNCH WITH RESPECT TO A DIE

CROSS-REFERENCE TO RELATED APPLICATION

This application claims the benefit of Japanese Patent Application No. 2003-148921 filed May 27, 2003, incorporated herein by reference.

BACKGROUND OF THE INVENTION

This invention relates to determining alignment or misalignment of a punch with respect to a die, in an apparatus in which workpieces are joined by self-piercing rivets, for example. One such apparatus is disclosed in U.S. Pat. No. 5,277,049 issued Jan. 11, 1994.

FIG. 1 shows an example of another self-piercing rivet setting apparatus in which the present invention may be employed. Typically, the apparatus 1 comprises a rigid C-shaped support frame 2, and a spindle unit 3 fixed to a first end (upper end in FIG. 1) of the C-shaped support frame. The spindle unit 3 holds an elongated tubular nosepiece 5 axially slidable through an end of the spindle unit (lower end in FIG. 1). A receiver 7 is fixed to the nosepiece 5 to receive self-piercing rivets supplied from a feed tube 6. A rod-shaped punch 9 is slidable axially in the nosepiece 5. A replaceable die 10 is seated at a position on the frame 2 facing the punch 9. The die has a portion centrally fitted in a bore 11.

Workpieces to be joined are placed between the punch and the die. A main shaft (not shown) axially movable in the spindle unit 3 is driven by a servomotor 13 and a reduction gear mechanism 14 to move the nosepiece 5 and the punch 9 toward the die 10. When the nosepiece 5 is brought into contact with a workpiece, the movement of the nosepiece toward the die is discontinued, but the punch 9 continues to move toward the die to press a self-piercing rivet, held axially at the end of the nosepiece, into the workpieces to be joined.

FIG. 2 shows the state after two workpieces 17 and 18, such as panels, are joined by a self-piercing rivet 15. As shown, the rivet includes a head 19 and a hollow smaller diameter leg 21 (typically of cylindrical shape) extending from the head toward the die 10. The rivet 15 is driven into the workpieces in such a manner that the leg 21 is expandingly deformed by the die while piercing the workpieces. The self-piercing rivet 15 penetrates the workpiece 17 located on the side of the punch 9 but stays in the workpiece 18 adjacent to the die 10 without penetrating that workpiece. Thus, no opening is formed in the exposed surface of the workpiece 18, preventing appearance degradation and blocking passage of noise and rainwater, for example. Panels typically joined in this manner are aluminum body panels employed in automobiles (e.g., to reduce weight) which are not easily welded.

If, during setting of a self-piercing rivet, as above described, the axis 23 of the punch and the rivet and the axis 25 of the die are aligned as shown in FIG. 2, a central protrusion 26 of the die 10 will be located at the center of the hollow leg 21, and the splayed portions of the leg will be symmetrically disposed with respect to the axis 25 of the die, whereby the workpieces 17, 18 are strongly connected. If, on the other hand, the axis 25 of the die 10 is misaligned with respect to the axis 23 of the punch and the rivet 15, as indicated by reference numeral 27 in FIG. 3, and if the misalignment is in excess of a tolerance, the expandingly deformed portion 22 of the leg 21 will not reliably join the workpieces 17, 18. More particularly, the tensile shear strength and peel strength of the workpieces will become unreliable. Furthermore, the leg 21 may protrude outside of the workpiece 18, forming an opening through which rainwater, for example, may pass, which may cause a corrosion problem.

Because of the manner in which each self-piercing rivet 15 is held in the nosepiece 5, there is little likelihood of misalignment between the punch 9 and the rivet. However, the die 10, located at a position away from the nosepiece 5, may become axially misaligned with respect to the punch and a rivet. The manufacturer of the riveting apparatus will take appropriate steps to avoid such misalignment. However, occurrences at a user's job site may cause misalignment beyond the control of the manufacturer. Resulting defective riveted joints may not be easily detected by the user of the riveting apparatus. Moreover, returning the riveting apparatus to the manufacturer to check alignment is burdensome and may, undesirably, require use of standby apparatus.

BRIEF DESCRIPTION OF THE INVENTION

The present invention provides a simple device and method for determining whether axial misalignment, if any, of a die relative to a punch is within an acceptable range. The invention uses a jig that substitutes for a replaceable die and that permits viewing of the relationship of the punch with respect to a punch-receiving axial hole in the jig. If the punch can enter the hole, any axial misalignment is within tolerance. If the punch cannot enter the hole, axial misalignment is excessive. Axial misalignment can be readily determined without disassembly of the rivet setting apparatus.

BRIEF DESCRIPTION OF THE DRAWINGS

The invention will be further described in conjunction with the accompanying drawings, which illustrate a preferred (best mode) embodiment, and wherein.

DETAILED DESCRIPTION OF THE INVENTION

Figure 1:
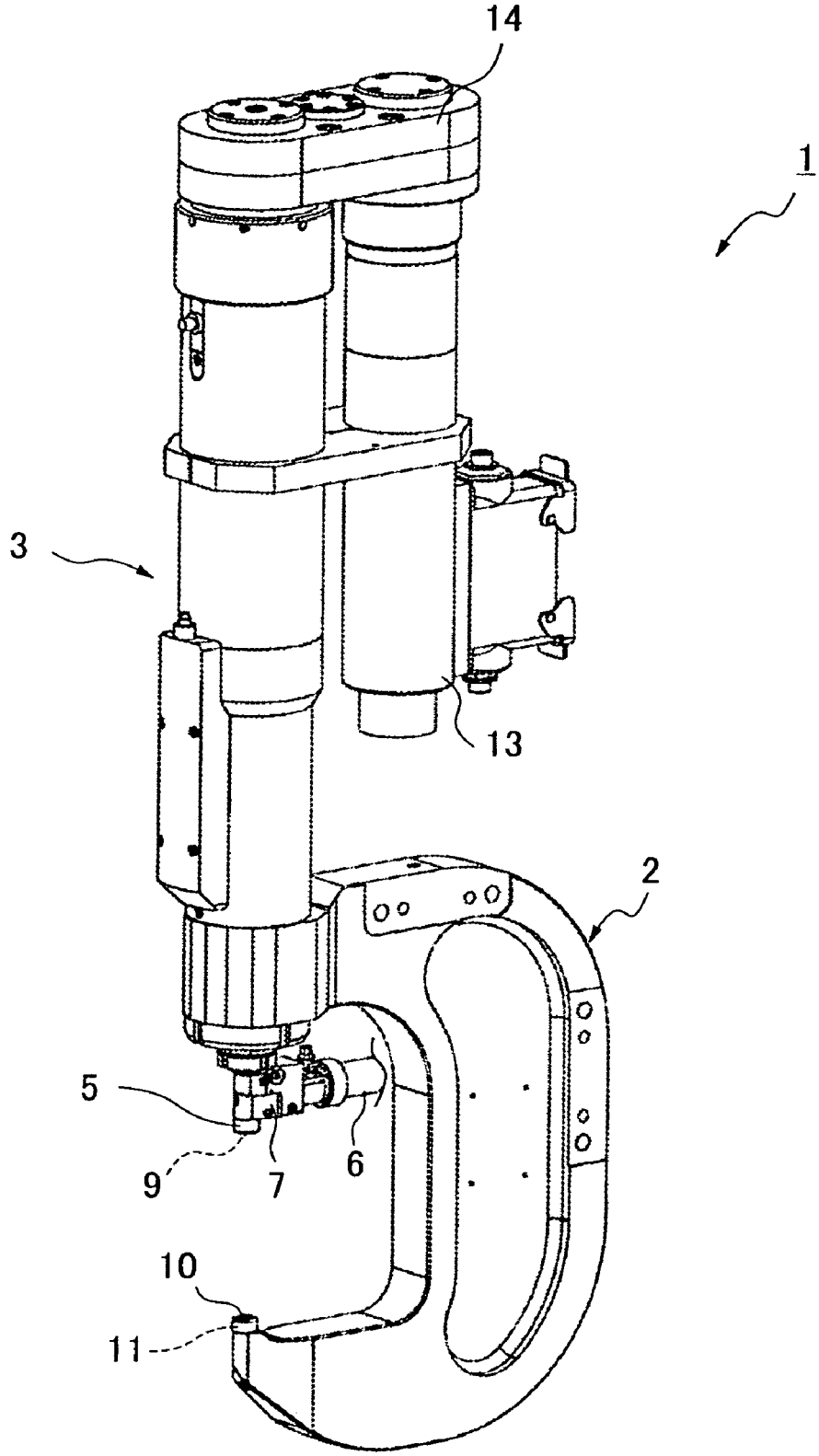
FIG. 1 is a perspective view of a self-piercing rivet setting apparatus in which the present invention may be used.
Figure 2:
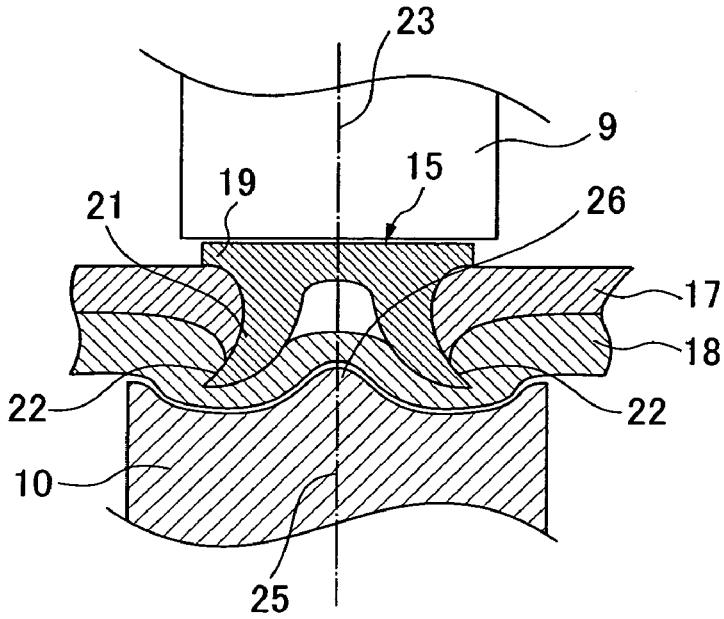
FIG. 2 is a sectional view showing the state after a plurality of workpieces are properly joined using a self-piercing rivet.
Figure 3:
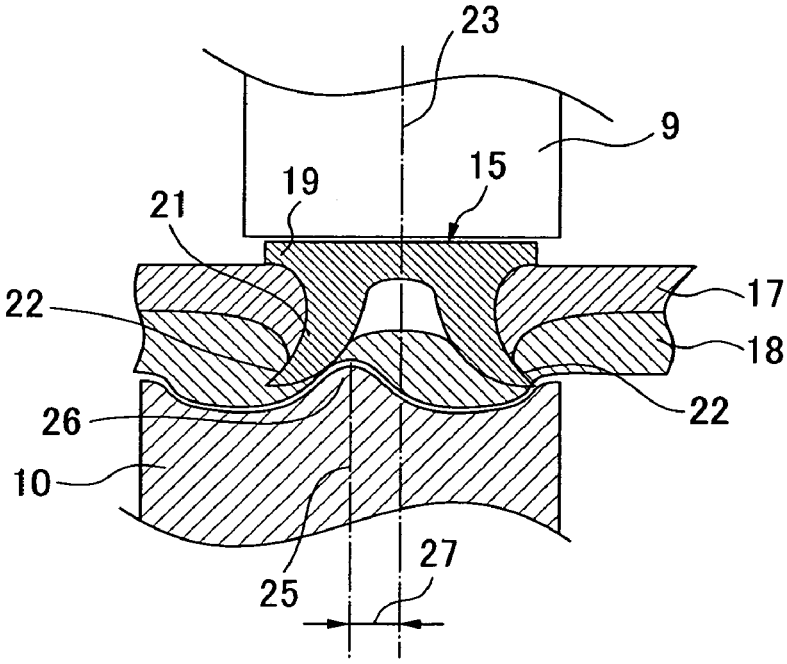
FIG. 3 is a sectional view showing the state after a plurality of workpieces are improperly joined due to axial misalignment of a die relative to a punch and a self-piercing rivet.
Figure 4:
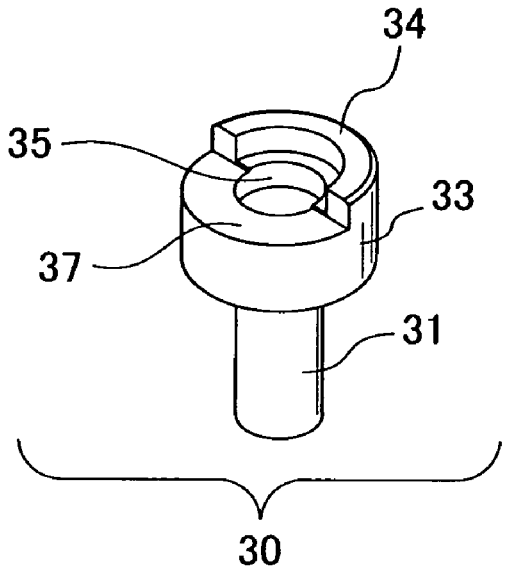
FIG. 4 is a perspective view of an axial misalignment determination jig according to one embodiment of the present invention.
Figure 5:
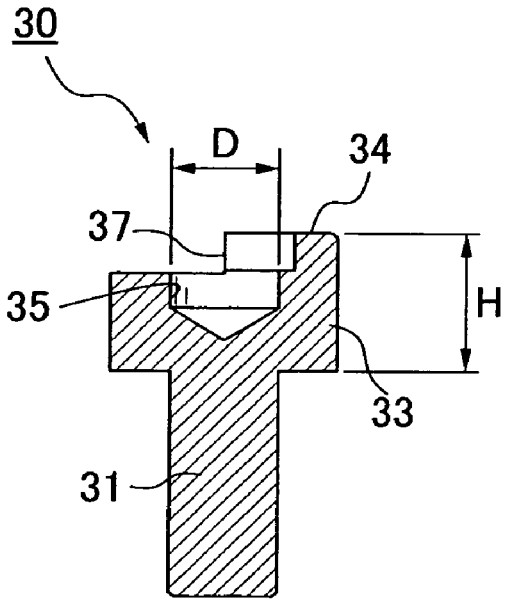
FIG. 5 is a vertical sectional view of the jig in FIG. 4.

FIGS. 4 and 5 show an axial misalignment determination jig 30 according to one embodiment of the present invention. The jig 30 can be used, for example, in the rivet setting apparatus 1 in FIG. 1, but is not limited to use in that apparatus. In the form shown, the jig 30 comprises a shank 31 and a head 33. In the preferred form, both the shank 31 and the head 33 of the jig are cylindrical, as shown in FIG. 4. The jig 30 is preferably molded of metal or hard plastic and can be readily reproduced at low cost.

The shank is adapted to be inserted into the die-receiving bore 11 of the C-shaped support frame 2 of the apparatus 1, with the head adjacent to the frame and facing the punch 9. The head is formed with an axial hole 35 for receiving the punch 9. The hole has an axis that is aligned with the axis of the die-receiving bore 11. The height H of the head above the frame 2 is approximately equal to the height of a portion of a die 10 protruding from the frame when the die is inserted in the bore 11.

The upper portion of the head 33 is constructed to permit viewing of the relationship between the punch 9 and the axial hole 35. For this purpose, a large notch 37 is provided at a single position of the head, but the shape and number of notches may vary, so long as the relationship between the punch 9 and the hole 35 can be viewed. Preferably, the axial hole is designed to have a diameter D satisfying the following formula:

D=the diameter of the punch+[the tolerance (or the allowable range) of the misalignment 27 between the axes of the punch (and the rivet) and the die]×2.

For example, given a punch diameter of 8 mm, and the tolerance of axial misalignment 27 of 0.5 mm, the diameter of the axial hole is set at 9 mm.

Figure 6:
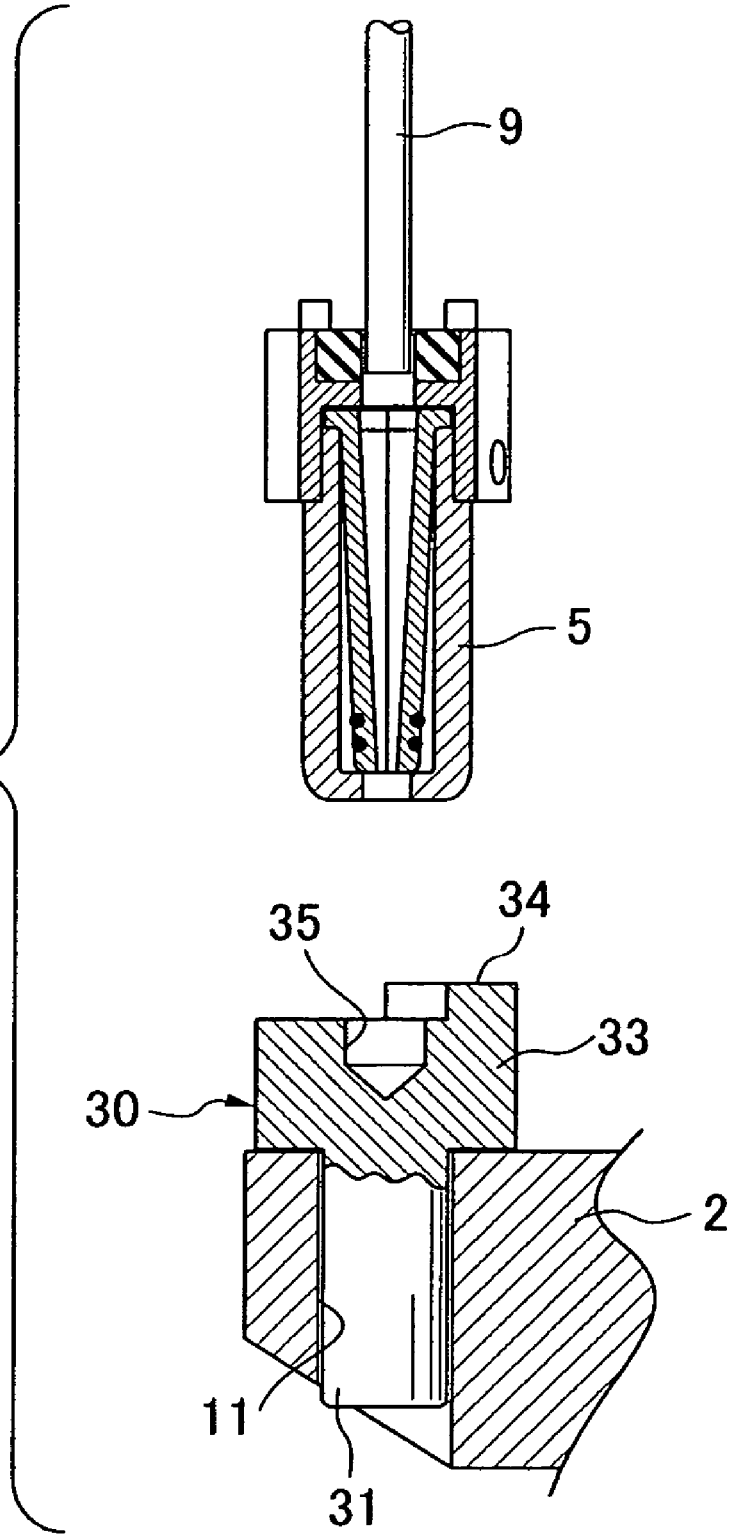
FIG. 6 is a sectional view showing the state before a nosepiece and a punch are moved toward an axial misalignment determination jig according to one embodiment of the present invention.
Figure 7:
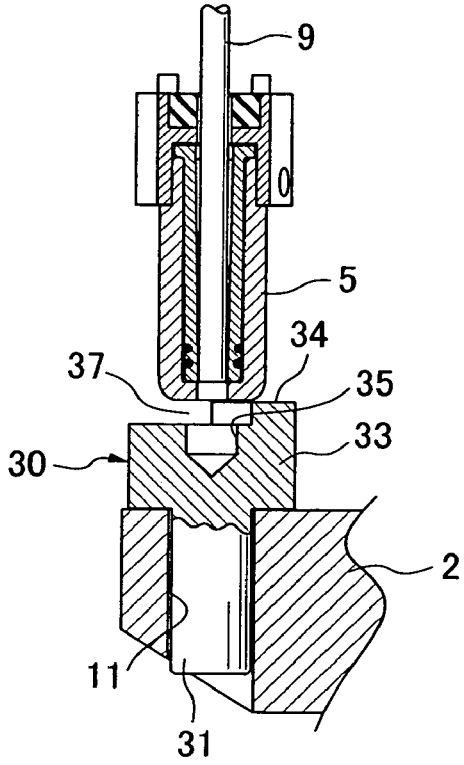
FIG. 7 is a sectional view showing the state after the nosepiece is moved from the position in FIG. 6, and brought into contact with a head of the jig.
Figure 8:
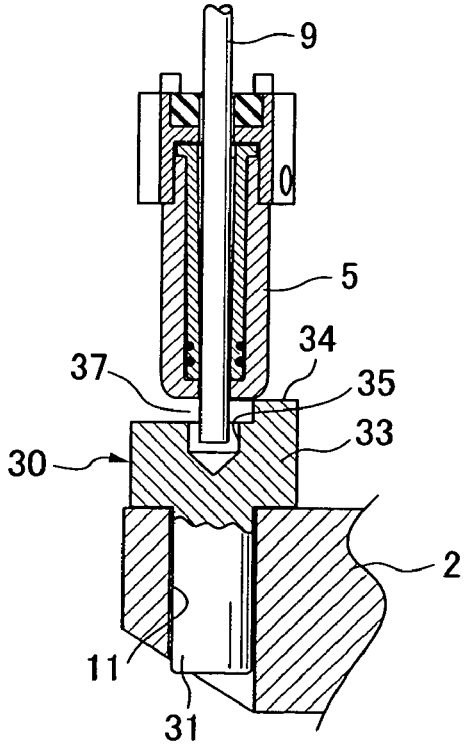
FIG. 8 is a sectional view showing the state after the punch is moved from the position in FIG. 7 so as to protrude from the nosepiece, and is inserted into an axial hole in the head of the jig.

FIGS. 6–8 show the manner in which the jig 30 can be used to determine axial misalignment. The shank 31 of the jig is inserted in the die-receiving bore 11 of the support frame 2 (absent a die) to locate the head 33 in opposition to the punch 9 and the nosepiece 5, as shown in FIG. 6. Then the rivet setting apparatus 1 is activated to move the nosepiece 5 and the punch 9 toward the jig 30 until the nosepiece abuts a surface 34 of the head 33, whereupon movement of the nosepiece toward the jig is discontinued, as shown in FIG. 7. However, the punch 9 continues to move toward the jig, and if the axial alignment of the punch 9 and the hole 35 is within an acceptable range, the punch enters the opening, as shown in FIG. 8. If it is observed through the notch 37 that the end of the punch 9 is not received in the axial hole 35, then it will be evident that the misalignment between the axis 25 of the die and the axis 23 of the punch (and the rivet) is out of tolerance. Suitable adjustments can then be made to correct such misalignment.

While a preferred embodiment of the invention has been shown and described, it will be apparent that changes can be made without departing from the principles and the spirit of the invention, the scope of which is defined in the accompanying claims. For example, the invention may be used in clinching apparatus.

What is claimed is:

1. For use in an apparatus in which a punch is moved axially relative to a die to form a joint, and in which the punch and the die are mounted on a frame, with the die removably supported in a bore, a jig for determining axial alignment or misalignment of the punch with respect to the die, wherein:

the jig is a single piece that has a shank and a head fixed immovably to the shank, the jig is constructed to substitute for a die, with the head adjacent to the frame and the shank fitted in the bore, the head has an axial hole into which the punch can only be inserted when the axis of the punch is aligned with the axis of the bore or when misalignment is within a predetermined range, and a portion of the head adjacent to the hole is constructed to permit viewing of the relationship of the punch and the hole.

2. A jig according to claim 1, wherein the head has an abutment surface constructed and disposed to engage a nosepiece of the apparatus having an opening through which the punch moves toward the hole in the head of the jig.

3. A jig according to claim 1, wherein the head has at least one notch to permit viewing of the relationship of the punch and the hole in the head.

4. A jig according to claim 1, wherein both the shank and the head are cylindrical.

5. For use in an apparatus in which a punch is moved axially relative to a die to form a joint, and in which the punch and the die are mounted on a frame, with the die removably supported in a bore, a jig for determining axial alignment or misalignment of the punch with respect to the die, wherein:

the jig has a shank and a head, the jig is constructed to substitute for a die, with the head adjacent to the frame and the shank fitted in the bore, the head has an axial hole into which the punch can be inserted when the axis of the punch is aligned with the axis of the bore or when misalignment is within a predetermined range, and a portion of the head adjacent to the hole is constructed to permit viewing of the relationship of the punch and the hole, wherein the height of the head extending from the frame when the jig is seated on the frame is substantially the same as the height of a portion of a die extending from the frame when the die is seated on the frame.

6. For use in an apparatus in which a punch is moved axially relative to a die to form a joint, and in which the punch and the die are mounted on a frame, with the die removably supported in a bore, a jig for determining axial alignment or misalignment of the punch with respect to the die, wherein:

the jig is a single piece that has a shank and a head fixed immovably to the shank, the jig is constructed to substitute for a die, with the head adjacent to the frame and the shank fitted in the bore, the head has an axial hole into which the punch can only be inserted when the axis of the punch is aligned with the axis of the bore or when misalignment is within a predetermined range, a portion of the head adjacent to the hole is constructed to permit viewing of the relationship of the punch and the hole, and the height of the head extending from the frame when the jig is seated on the frame is substantially the same as the height of a portion of a die extending from the frame when the die is seated on the frame.

* * * * *